US006328541B1

(12) United States Patent
Veronesi et al.

(10) Patent No.: US 6,328,541 B1
(45) Date of Patent: Dec. 11, 2001

(54) THERMAL BARRIER AND REACTOR COOLANT PUMP INCORPORATING THE SAME

(75) Inventors: Luciano Veronesi; James A. Drake, both of Pittsburgh, PA (US)

(73) Assignee: Westinghouse Electric Company LLC, Pittsburgh, PA (US)

( * ) Notice: Subject to any disclaimer, the term of this patent is extended or adjusted under 35 U.S.C. 154(b) by 0 days.

(21) Appl. No.: 09/520,860

(22) Filed: Mar. 7, 2000

(51) Int. Cl.[7] ..... F04B 17/00; F04B 35/00

(52) U.S. Cl. ..... 417/373; 417/366; 415/180; 376/404

(58) Field of Search ..... 417/377, 373, 417/366–371; 415/175, 177, 178, 179, 180; 376/404

(56) References Cited

U.S. PATENT DOCUMENTS 4,886,430 * 12/1989 Veronesi et al. ..... 417/423.13
5,118,466 * 3/1992 Raymond et al. ..... 376/404
5,604,777 * 2/1997 Raymond et al. ..... 376/310

* cited by examiner

*Primary Examiner*—Teresa Walberg
*Assistant Examiner*—Thor Campbell

(57) ABSTRACT

A thermal barrier for a nuclear reactor coolant pump includes a stack of pancake cooling coils encircling the pump shaft where it enters the pump chamber. This stack of coiling coils has an irregular peripheral surface formed by axially extending, diametrically opposed, inlet and outlet tubes which are circumferentially indexed for each pancake coil. The inner surface of a cylindrical cover has a complimentary inner peripheral surface formed by two sets of diametrically opposed cascaded steps so that the volume of the annulus between the coil stack and cover is minimized to reduce stratification of cooling water injected into the cover. A collar around the pump shaft at the opening in the end wall of the cover extends axially into the coil stack to prevent vortices produced by the spinning shaft from flowing across the end wall of the cover, while circumferentially spaced holes in the collar prevent significant alteration of the thermal conditions of the pancake coiling coils. An integral flange on the collar serves as a shim for the stack of coils. An external insulator includes a sleeve with a low coefficient of thermal expansion shrink fit over a groove in the outer surface of the cylindrical cover to form an annular chamber which is divided by a number of nested cans into a plurality of concentric sections each containing stagnant reactor coolant.

29 Claims, 6 Drawing Sheets

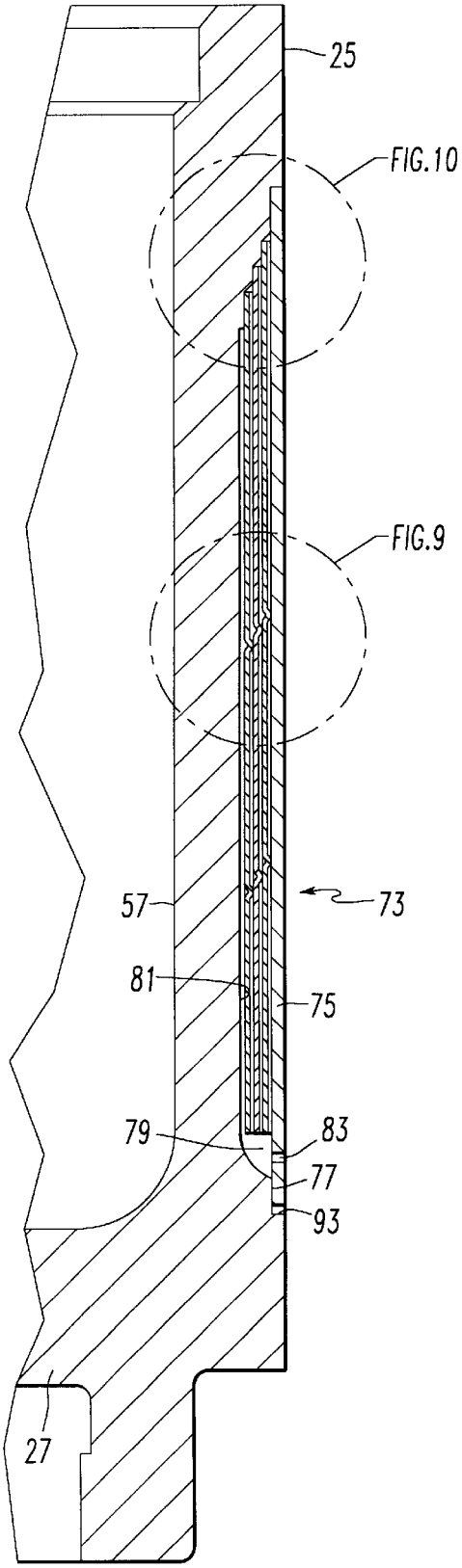
FIG.8
FIG.9
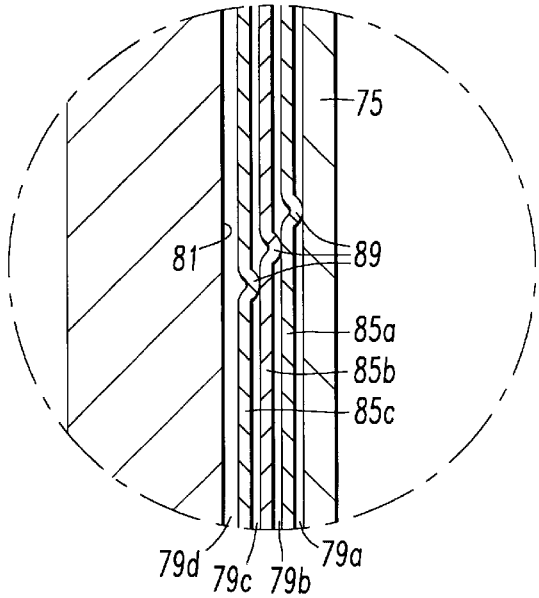
FIG.10
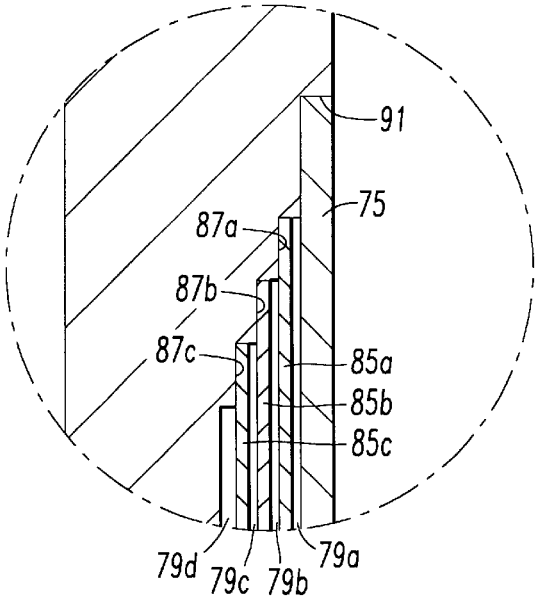

THERMAL BARRIER AND REACTOR COOLANT PUMP INCORPORATING THE SAME

BACKGROUND OF INVENTION

1. Field of the Invention

This invention relates to pumps utilized to circulate coolant water in nuclear reactors. More particularly, it relates to a thermal barrier which protects pump seals and bearings from the hot reactor coolant water and to a pump incorporating such a thermal barrier.

2. Background Information

The pumps which circulate coolant water through a nuclear reactor are subjected to harsh conditions. The reactor coolant water in a pressurized water reactor (PWR) is typically at a pressure of about 2,250 psi and a temperature in excess of 500 degrees Fahrenheit. The bearings and seals for the pump shaft are protected from these conditions by a thermal barrier. A common type of thermal barrier includes a cylindrical cover which seats in a recess in the pump housing where the pump shaft extends into the pump chamber. This cover has an end wall through which the pump shaft extends into the pump chamber. Coolant water is injected through a flange on the opposite end of the cover seated in the pump housing and flows outward into the pump chamber through a clearance between the pump shaft and the opening in the end wall of the cover. As a back-up to the cooling provided by this injected water, a stack of pancake cooling coils encircle the shaft under the cover. Inlet and outlet sections of the pancake cooling coils extend axially from the periphery of the coil stack and through the cover flange. A separate supply of cooling water can be circulated through this closed loop system. Additional thermal protection is provided by an annular insulator disposed against the inner surface of the cover sidewall. Such thermal barriers maintain the temperature of the water inside the cover well below the 550° Fahrenheit of the reactor coolant water being pumped and also below the 220° Fahrenheit maximum temperature for the seals and bearings.

However, after many years of service some cracks have developed at the intersection between the end and side walls of the cover, in the weld between the cover side wall and flange, and in the flange adjacent to the pancake cooling coil inlet and outlet penetrations and the penetration for the injection water.

There is a need therefore for an improved thermal barrier for reactor coolant pumps and a reactor coolant pump incorporating such an improved thermal barrier.

SUMMARY OF THE INVENTION

This need and others are satisfied by the invention which is based on the recognition that the current configuration of thermal barriers for reactor coolant pumps results in poor mixing of the relatively cool injection water that enters the cover at about 130° Fahrenheit and at a flow rate of about 8 gallons per minute, and the hotter (about 180° Fahrenheit) water within the thermal barrier. The flow stratification created as a result, exposes the inside walls of the thermal barrier cover to fluctuating water temperatures. The higher the steady state wall temperature of the thermal barrier, the worse are the effects of the water temperature fluctuations in inducing cyclic thermal stresses in the barrier. Vortices caused by the high-speed rotation of the pump shaft contribute to the uneven temperature distribution across the end wall of the thermal barrier cover. Finally, it has been determined that gaps open between the internal can insulator and the inner surface of the cover wall thereby aggravating the thermal fluctuation effects.

Accordingly, in the thermal barrier of the invention a generally cylindrical cover has an inner surface which is complimentary to the irregular peripheral surface of the pancake cooling coil stack resulting from the axially extending peripheral inlet and outlet tubing of the pancake cooling coils. This minimizes the free flowing water volume in the annulus between the stack of pancake cooling coils and the inside surface of the cylindrical cover to reduce the tendency for flow stratification and to increase flow turbulence which produces better mixing of the hot and cold streams.

As another aspect of the invention, a collar extends along the pump shaft from the end wall of the generally cylindrical body to prevent vortices from developing between the end wall and the stack of pancake cooling coils. This collar has a plurality of circumferentially distributed radially extending through holes. Preferably, this collar is combined with an annular shim disposed between the end wall of the generally cylindrical cover and the stack of pancake cooling coils to preload the coils. In this arrangement the collar assures centering of the shim.

As an additional aspect of the invention, the internal can insulator is eliminated in favor of an external insulator which extends circumferentially around and axially along at least a portion of the generally cylindrical cover. The external insulator comprises an external sleeve forming, with the generally cylindrical cover, an annular chamber containing substantially stagnant reactor coolant water. Preferably, a plurality of concentrically disposed annular cans divide the annular chamber into a plurality of concentric sections each containing reactor coolant water. The annular chamber, and therefore the concentric sections, communicate with the pump chamber sufficiently to equalize the pressure but yet maintain the coolant chamber water substantially stagnant.

The external sleeve is shrink fit onto the generally cylindrical cover and fixed in space by axially spaced shoulders on the cylindrical cover. Preferably, the sleeve has a lower coefficient of thermal expansion than the cylindrical cover.

BRIEF DESCRIPTION OF DRAWINGS

A full understanding of the invention can be gained from the following description of the preferred embodiments when read in conjunction with the accompanying drawings in which:

FIG. 8 is a sectional view in enlarged scale through the cylindrical cover illustrating the construction of the external insulator which forms part of the invention.

FIG. 9 is a section of FIG. 8 shown in enlarged scale.

FIG. 10 is another section of FIG. 8 shown in enlarged scale.

DESCRIPTION OF THE PREFERRED EMBODIMENTS

Figure 1:
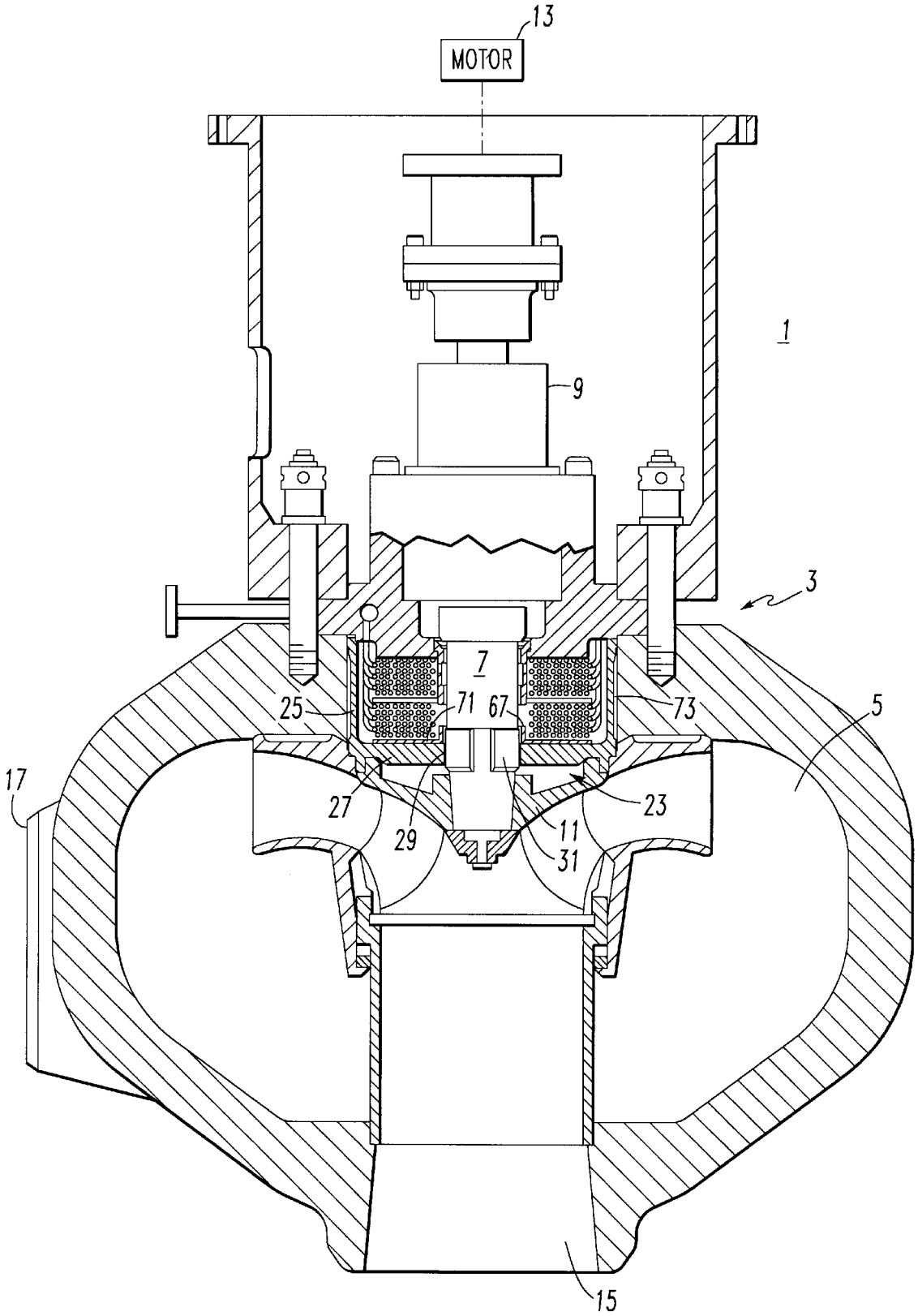
FIG. 1 is a longitudinal sectional view through a reactor coolant pump in accordance with the invention.

Referring to FIG. 1, the reactor coolant pump 1 includes a pump housing 3 forming a pumping chamber 5. A pump shaft 7 supported by bearings 9 mounted in the housing 3 extends into the pump chamber 5. An impeller 11 is secured to the free end of the pump shaft 7 in the pump chamber 5. The pump shaft 7 is rotated by a motor shown schematically at 13 to drive the impeller 11 which draws reactor coolant in through an inlet 15 and discharges it through an outlet 17. As better seen in FIG. 2, sleeve 19 carries upper and lower labyrinth seals 21u and 211 which seal against the pump shaft 7.

As previously discussed, the reactor coolant water in the pump chamber 5 is at a temperature of about 550° F. and a pressure of about 2250 psi. In order to protect the seals 21 and the bearings 9 from these harsh conditions, a thermal barrier 23 is provided. The thermal barrier 23 includes a generally cylindrical cover 25 having an end wall 27 with a central opening 29 through which the pump shaft 7 extends. A thermal sleeve 31 is provided on the pump shaft 7 at the opening 29.

A number of mounting bolts 33 extend through longitudinal bores 35 in diametrically opposed sectors of the cylindrical cover 25 (see FIGS. 2 and 5) to secure it to the pump housing 3. This arrangement eliminates cracking in the welds which formerly secured the cover to the housing. An annular seal 37 is provided between the cylindrical cover and the housing.

Figure 3:
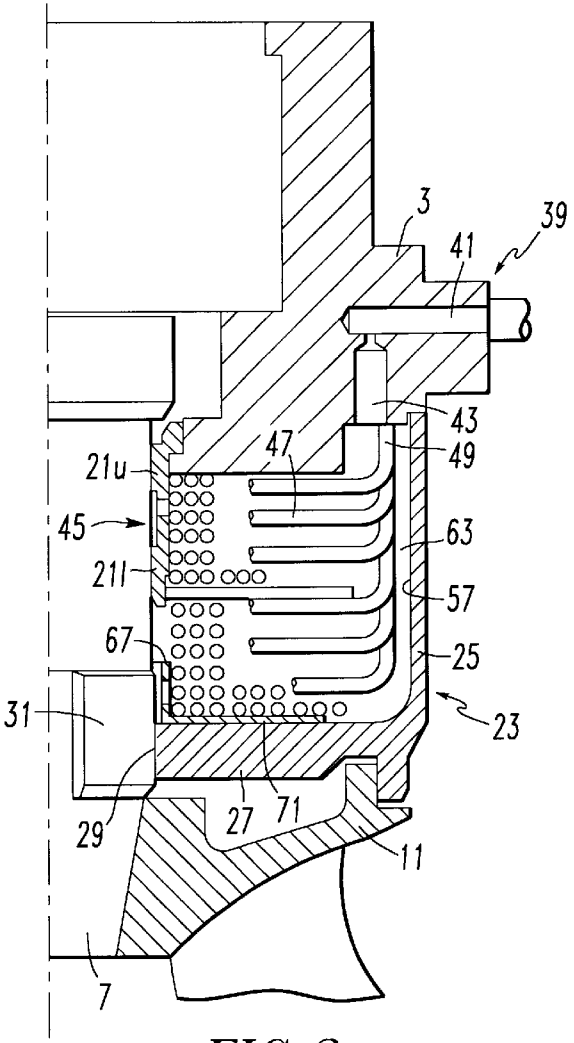
FIG. 3 is also a fragmentary view of a section through the pump of FIG. 1 angularly displaced from the view of FIG. 2.

Referring to FIG. 3, cooling water is injected inside the cylindrical cover 25 through a passage 39 which includes a radial bore 41 communicating with an axial bore 43 in the housing 3. The axial bore 33 is necked down at its intersection with the radial bore 41 to provide the required pressure drop for a flow meter (not shown) yet precludes the injection of a high velocity stream inside the cylindrical cover 25. This injected cooling water provides cooling for the pump shaft 7 and seals 21 and passes out of the cover into the pump chamber 5 through the annular gap formed by the opening 29 in the end wall 27 of the cover and the thermal sleeve 31 on the pump shaft.

Figure 4:
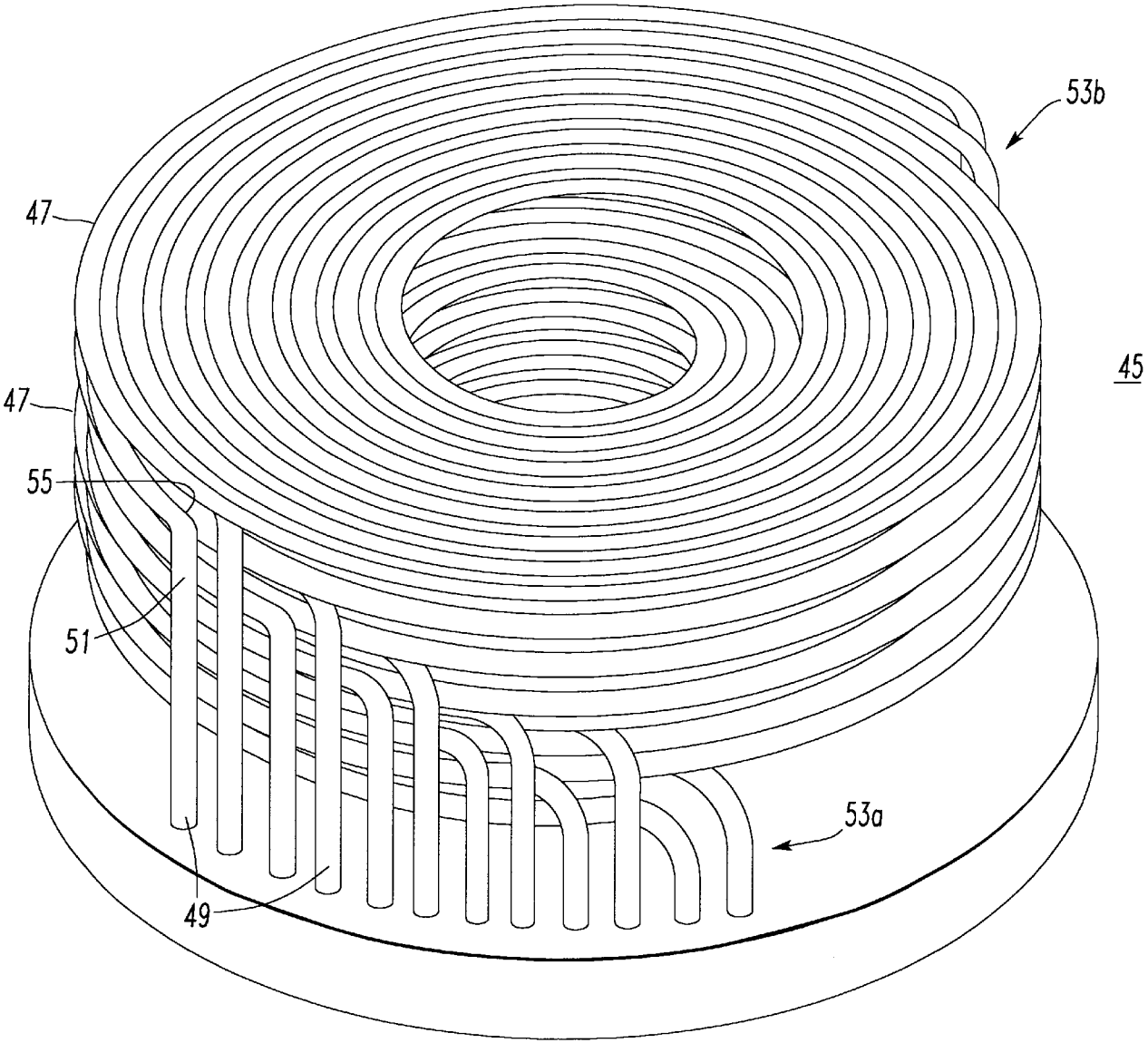
FIG. 4 is an isometric view of a stack of pancake cooling coils which form part of the pump of FIG. 1 shown inverted.

Secondary cooling of the pump shaft and seals is provided by a stack 45 of pancake cooling coils 47. As best seen in FIG. 4, each of the pancake cooling coils 47 has inlet and outlet tubes 49 extending axially from diametrically opposed points on the periphery of the coil. The inlet and outlet tubes 49 of the successive pancake coils 47 in the stack 45 are angularly displaced from those of the adjacent coil. This produces an irregular peripheral surface 51 on the stack 45. As all of the inlet and outlet tubes 49 extend upward to the pump housing, this irregular peripheral surface 51 forms two diametrically opposed sets 53*a* and 53*b* of cascaded steps 55. In the prior art thermal barriers, the internal surface of the cover was cylindrical and of a diameter to accommodate the inlet and outlet tubing of the pancake cooling coils. Thus, there was a fairly large annular space between the stack 45 of pancake cooling coils and the cover adjacent to the portions of the stack other than where the cooling tubing extended. We have found that this tended to produce flow stratification which exposed the walls of the cover to fluctuating water temperatures. This in turn induced cyclic thermal stresses which we believe led to the cracking of the cover, particularly at the interface between the side wall and end wall.

Figure 5:
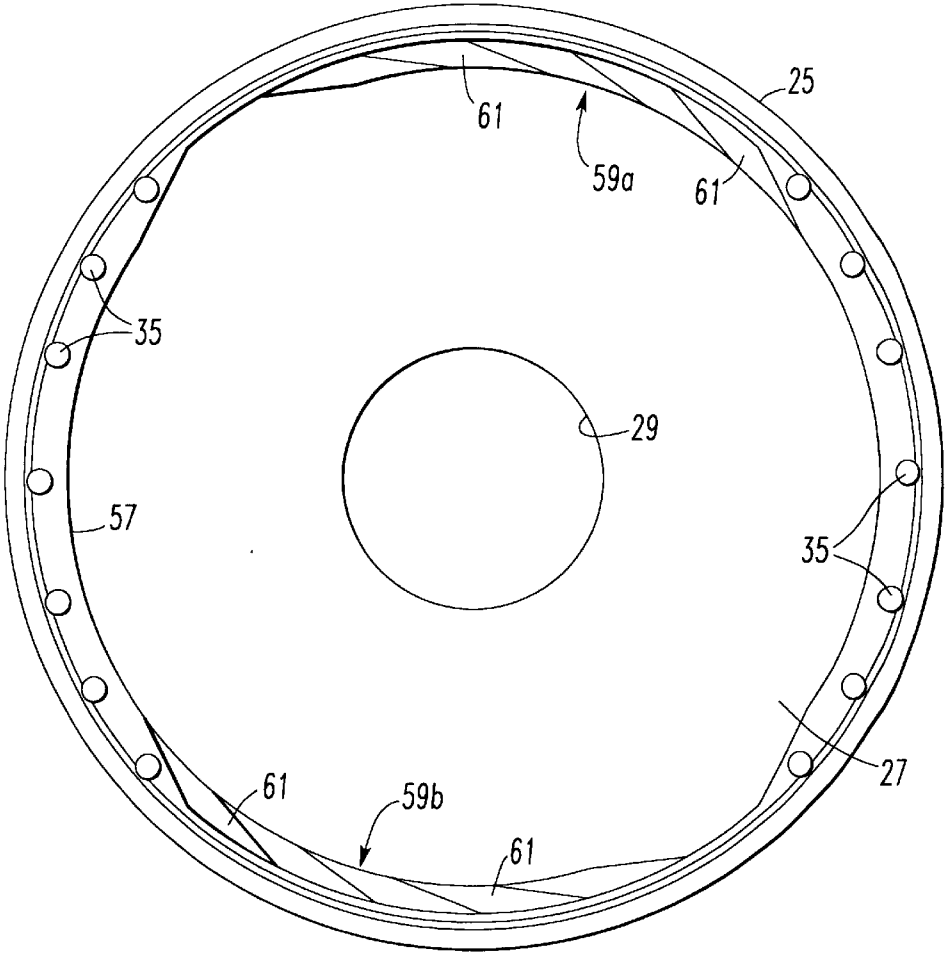
FIG. 5 is a top plane view of a cover which forms part of the pump showing the cascaded steps in the inner surface of the cover wall.
Figure 6:
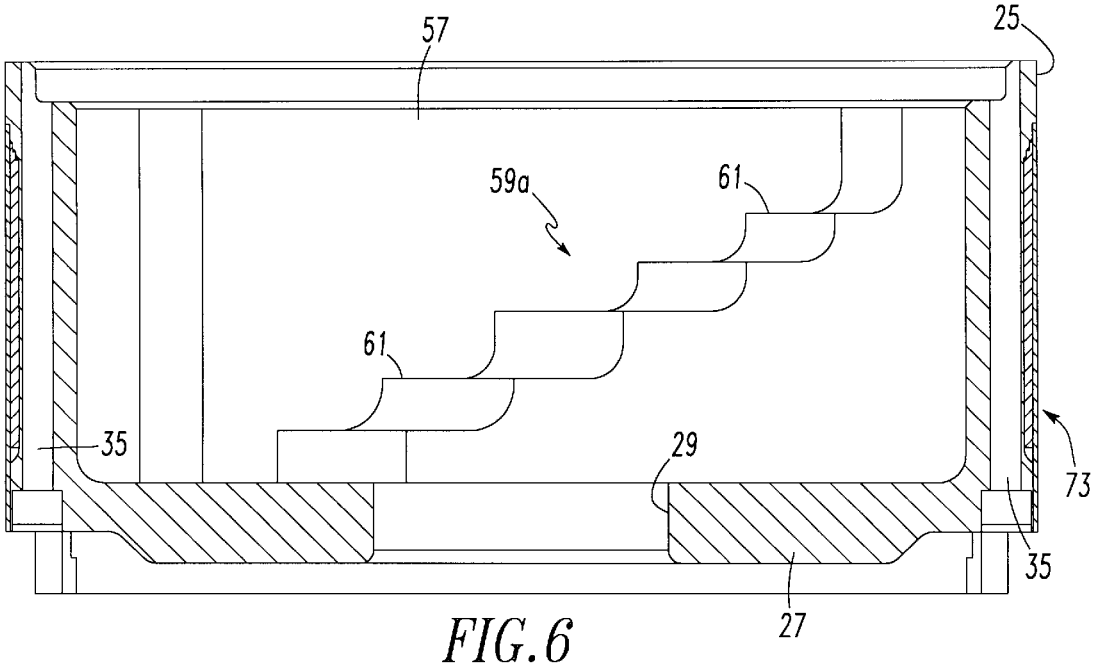
FIG. 6 is a vertical section through the cylindrical cover showing the cascaded steps.

In accordance with the invention, the cylindrical cover 25 is provided with an inner peripheral surface 57 which is complimentary to the irregular outer peripheral surface 51 of the stack 45 of pancake cooling coils. Thus, as can be seen in FIGS. 5 and 6, this inner surface 57 of the cover is provided with two diametrically opposed sets 59*a* and 59*b* of cascaded steps 71 which nest with sets 53*a* and 53*b* of cascaded steps on the stack 45 of cooling coils. This arrangement minimizes the annulus 63 (see FIG. 3) between the stack 45 of pancake cooling coils and the inner surface 57 of the cylindrical body 25 and provides a generally annular flow path for injection water. The radial dimension of this flow path is about 0.125(3.175 mm) to 0.25(6.35 mm) and preferably about 0.125 inches (3.175 mm). This provides a twofold benefit. It minimizes flow stratification of cooling water and increases flow turbulence which in turn promotes better mixing of the injection flow with the water in the thermal barrier.

As mentioned, the stack 45 of pancake cooling coils provides an alternate means of providing cooling for the seals 21 and bearings 9. Additional cooling water is circulated in a closed loop through these pancake cooling coils. Without injection of cooling water through the passage 39, reactor coolant in the pumping chamber 5 flows through the gap between the opening 29 in the end wall 27 of the cover and the pump shaft 7 and flows upward and outward over the lower half of the stack 45 of cooling coils. As can be seen from FIG. 2 the sleeve 19 has a radial flange 65 at its lower end which extends outward between upper and lower halves of the stack 45 of pancake cooling coils. This results in a flow of reactor coolant radially outwardly in the lower half of the stack and then radially inwardly in the upper half This coolant then passes through the labyrinth seals 21 and through the bearings.

Figure 2:
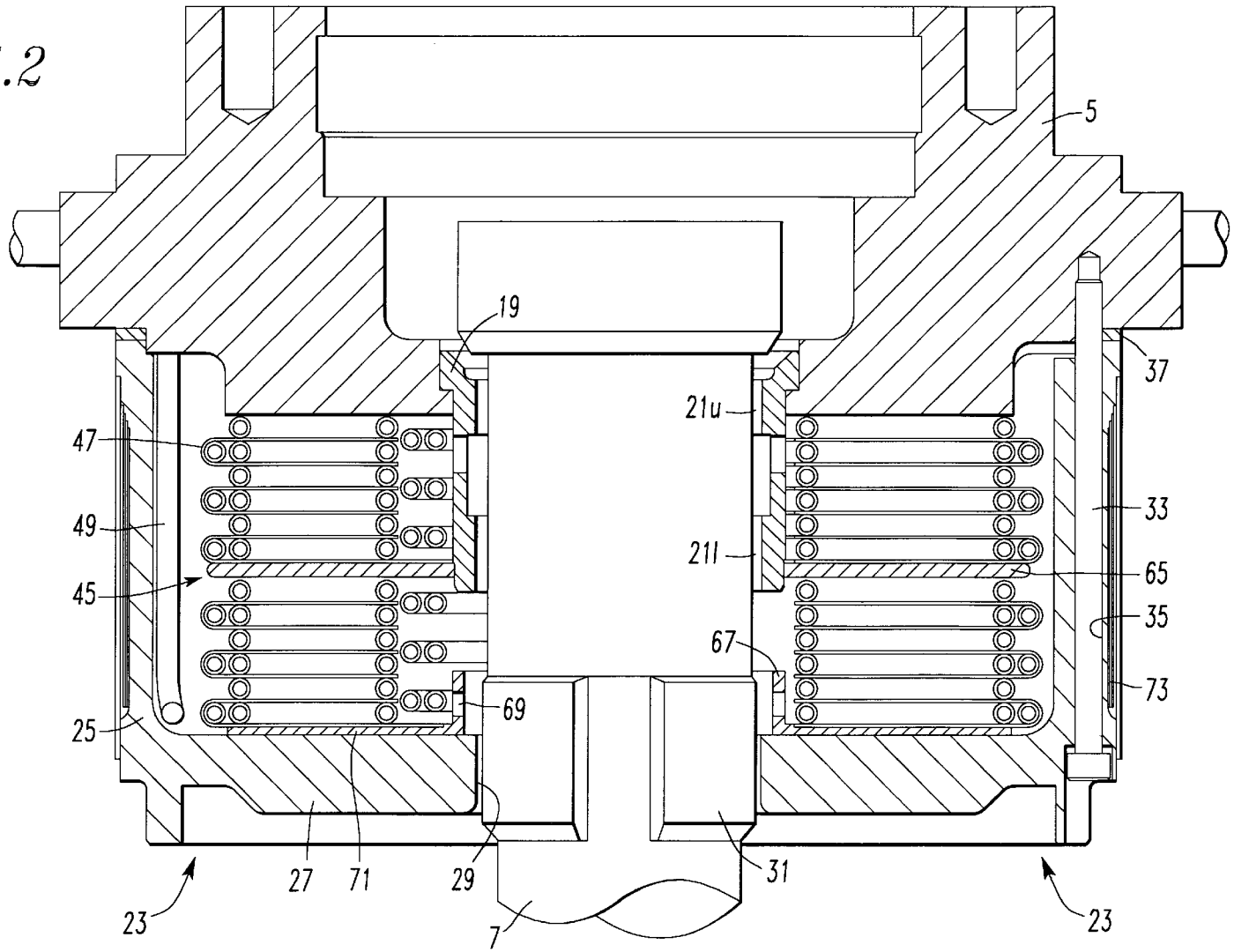
FIG. 2 is a fragmentary view of a section through the pump of FIG. 1 shown in enlarged scale.
Figure 7:
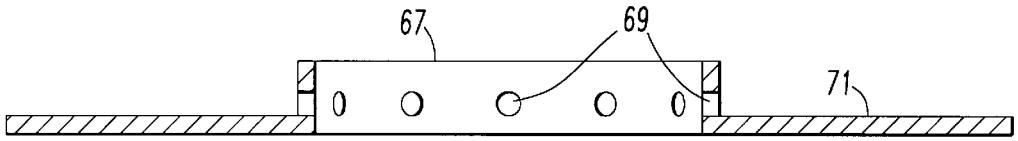
FIG. 7 is a longitudinal sectional view through an anti-vortex dam which forms part of the pump of FIG. 1.

The thermal barrier 23 of the invention further includes a cylindrical collar 67 which extends along the pump shaft 7 from the central opening 29 in the end wall 27 and axially into the stack 45 of pancake cooling coils as can be seen in FIG. 2. This collar 67, which is shown in section in FIG. 7, forms an anti-vortex dam which prevents vortices generated by the spinning of the pump shaft 7 from flowing radially across the lower region of the cover which could cause thermal fluctuations on the lower inside surfaces of the cover. The collar 67 has a number of radially extending, circumferentially spaced openings 69 so that thermal conditions of the heat exchanger coils are not significantly altered by the presence of the collar. Preferably, an annular flange 71 extends radially outward from the lower end of the collar adjacent the end wall 27. This flange 71 which is inserted between the stack of pancake cooling coils and the end wall 27 performs the function of the previously provided shim which preloads the stack of pancake cooling coils and can be machined to accommodate tolerance stackups in the assembly which can vary from pump to pump. The openings 69 extend down to the flange 71 to fully drain the cover for maintenance.

As mentioned, it was also found that the previously used internal insulator sleeve provided a source for thermal stresses by allowing hot coolant to enter a gap between the lower end of the internal barrier and the cylindrical cover.

The present invention eliminates this internal insulator, and provides instead, an external insulator 73. As best seen in FIGS. 8–10, the external insulator 73 includes a sleeve 75 which forms with the external surface 77 of the cylindrical body 25 an annular chamber 79. Preferably this annular chamber is formed by an annular groove 81 in the peripheral surface 77 of the cylindrical body 25. This annular chamber 79 communicates with the pump chamber 5 through a small opening 83. This opening 83 allows reactor coolant to fill the chamber 79. The size of the opening 83 is such that the pressure within the annular chamber 79 is equalized with the pressure in the pump chamber 5, but the reactor coolant within the annular chamber 79 remains substantially stagnant. In the exemplary embodiment of the invention this opening 83 is about 0.125 inches (3.175 mm) in diameter. This stagnant layer of reactor coolant provides an annular insulating layer for the cover.

Preferably, the annular chamber 79 is divided into a number of concentric annular sections 79*a*–79*d* by a series of nested annular cans 85*a*–85*c*. In the exemplary external insulator 73, the groove 81 has a series of annular steps 87*a*–87*c* to which the upper ends of the cans 85*a*–85*c*, respectively, are welded. Thus, the lower ends of the cans are open so that the concentric sections 79*a*–79*d* of the chamber 79 are in communication. The radial dimension of the concentric sections 79*a*–79*d* of the chamber 79 are maintained by dimples 89 on the cans 85*a*–85*c*. This radial dimension of the concentric sections 79*a*–79*d* is preferably about 0.05 inches or less.

The insulator sleeve 75 is shrink-fit onto the cylindrical body 25. Furthermore, the insulator sleeve 75 is made of a material with a coefficient of thermal expansion which is lower than the coefficient of thermal expansion of the cylindrical cover 25. In the exemplary thermal barrier this is achieved by making the cylindrical cover of 304 stainless steel which has a coefficient of thermal expansion of about 9.5 to 9.6 inch/inch/degree Fahrenheit (17.195 to 17.376 mm/mm/degree Centigrade), while the insulator sleeve 75 is made of alloy 625 having a coefficient of thermal expansion of about 7.1 inch/inch/degree Fahrenheit (12.85 mm/mm/degree Centigrade). The insulator sleeve 73 is further assured of being retained in place on the cylindrical cover 25 by annular shoulders 91 and 93. These shoulders have a radial dimension of about 0.190 inch (4.826 mm) at the upper end and 0.030 inch (0.762 mm) at the lower end. The insulator sleeve 73 is heated to about 900° for shrink fitting on the cylindrical body 25 and inserted over the 0.30 inch (0.762 mm) shoulder.

The thermal barrier of the invention is expected to reduce the incidence of cracking by minimizing the volume of injected cooling water to reduce stratification through nesting of the pancake cooling coil stack with steps machined into the inner surface of the cylindrical cover. It will further reduce cracking by providing a collar which suppresses vortices extending across the lower regions of the cover. Also, it reduces the thermal gradient through the cylindrical cover wall by providing an insulator on the outer surface of the cylindrical cover. This also eliminates the temperature stresses resulting from water getting under the edge of the prior art internal insulator. Cracking in the weld securing the mounting flange of the prior art barrier has been eliminated by using a bolted connection instead.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A thermal barrier for a reactor coolant pump having a pump housing with a pump chamber, and an impeller mounted on a pump shaft in a pump chamber for pumping reactor coolant water through said pump chamber, and seals sealing said pump shaft adjacent said pump chamber, said thermal barrier comprising:

a generally cylindrical cover mounted to said pump housing in said pump chamber concentrically with said pump shaft; and an external insulator extending circumferentially around and axially along at least a portion of said cylindrical cover.

2. The thermal barrier of claim 1 wherein said external insulator comprises a sleeve disposed over said generally cylindrical cover and forming with said generally cylindrical cover an annular chamber containing reactor coolant water.

3. The thermal barrier of claim 2 wherein said annular chamber communicates with said pump chamber through a passage sufficiently to substantially equalize pressure in said annular chamber with pressure in said pump chamber, yet maintains said reactor coolant water in said annular chamber substantially stagnant.

4. The thermal barrier of claim 2 wherein said external insulator further comprises at least one annular can dividing said annular chamber into concentric sections each containing reactor coolant water.

5. The thermal barrier of claim 4 wherein said at least one annular can comprises a plurality of concentric annular cans dividing said annular chamber into a plurality of concentric sections each containing reactor coolant water.

6. The thermal barrier of claim 5 wherein said concentric sections of said annular chamber communicate with each other.

7. The thermal barrier of claim 5 wherein said annular cans have radially extending dimples which set a radial dimension for said concentric sections of said annular chamber.

8. The thermal barrier of claim 5 wherein said annular chamber is formed by an annular groove in an external surface of said generally cylindrical cover, and said sleeve axially covering said annular groove.

9. The thermal barrier of claim 8 wherein said annular groove has axially spaced steps at one end and each of said plurality of annular cans is secured to a step.

10. The thermal barrier of claim 9 wherein said sleeve is shrink fit over said annular groove in said generally cylindrical cover to form said annular chamber.

11. The thermal barrier of claim 2 wherein said sleeve is shrink fit over said generally cylindrical cover to form said annular chamber.

12. The thermal barrier of claim 11 wherein said sleeve has a smaller coefficient of thermal expansion than said generally cylindrical cover.

13. The thermal barrier of claim 11 wherein said generally cylindrical cover has at least one radially outwardly extending shoulder fixing an axial position of said sleeve to enclose said annular chamber.

14. A thermal barrier for a reactor coolant pump having a pump housing with a pump chamber, an impeller mounted on a pump shaft in said pump chamber for pumping reactor coolant water through said pump chamber, and seals sealing said pump shaft adjacent said pump chamber, said thermal barrier comprising:

a generally cylindrical cover with a circular end wall through which said pump shaft extends; and a plurality of a pancake cooling coils disposed along said pump shaft inside said generally cylindrical cover and having peripheral axially extending input and output tubes to form a coil stack with an irregular axially extending peripheral surface, said cylindrical cover having an axially extending inner surface complimentary to said irregular axially extending peripheral surface of said coil stack.

15. The thermal barrier of claim 14 wherein said irregular axially extending peripheral surface on said coil stack and said complimentary axially extending inner surface of said cylindrical cover form a generally annular flow path for injection water having a radial dimension no more than about 0.125 inch (3.175 mm).

16. The thermal barrier of claim 15 wherein said generally annular flow path between said irregular axially extending peripheral surface on said coil stack and said complimentary axially extending inner surface of said cylindrical cover has a radial dimension of about 0.125 inch (3.175 mm) to 0.25 inch (6.35 mm).

17. The thermal barrier of claim 14 wherein said peripheral axially extending input and output tubes of successive ones of said plurality of pancake cooling coils are angularly displaced from one another and said axially extending inner surface of said cylindrical cover has a plurality of cascaded steps accommodating the angularly displaced peripheral axially extending input and output tubes of successive ones of said plurality of pancake cooling coils.

18. The thermal barrier of claim 17 wherein said peripheral axially extending input and output sections on said plurality of pancake cooling coils are diametrically opposed and said axially extending inner surface of said cylindrical cover has two diametrically opposed sets of cascaded steps.

19. A thermal barrier for a reactor coolant pump having a pump housing with a pump chamber, an impeller mounted on a pump shaft in said pump chamber for pumping reactor coolant water through said pump chamber and seals sealing said pump shaft adjacent said pump chamber, said thermal barrier comprising:

a generally cylindrical cover with a circular end wall having a central opening for said pump shaft;

a stack of pancake cooling coils disposed along said pump shaft inside said cylindrical cover; and a collar extending along said pump shaft from said central opening in said end wall, and axially into said stack of pancake cooling coils.

20. The thermal barrier of claim 19 wherein said collar as a plurality of circumferentially distributed radially extending through holes.

21. The thermal barrier of claim 19 wherein said collar has a radial flange adjacent said end wall and extending between said end wall and said stack of pancake cooling coils to form an annular shim for said stack of pancake cooling coils.

22. The thermal barrier of claim 21 wherein said collar has a plurality of circumferentially distributed radially extending through holes.

23. The thermal barrier of claim 20 wherein said through holes extend axially at least to said annular shim.

24. A reactor coolant pump comprising:

a pump housing with a pump chamber;

a pump shaft extending into said pump chamber;

a impeller mounted on said pump shaft in said pump chamber for pumping reactor coolant water through said pump chamber;

seals sealing said pump shaft adjacent said pump chamber; and a thermal barrier comprising:

a generally cylindrical cover mounted to said pump housing in said pump chamber concentrically said with pump shaft and having an end wall with a central opening through which said pump shaft extends:

an external insulator extending circumferentially around and axially along at least a portion of the said cylindrical cover.

25. The reactor coolant pump of claim 24 wherein said thermal barrier further includes a stack of pancake cooling coils extending along said pump shaft inside said cylindrical cover and having peripheral axially extending input and output tubes to form a generally annular coil stack with an irregular axially extending peripheral surface, said cylindrical cover having an axially extending inner surface complimentary to said irregular axially extending peripheral surface of said stack of pancake cooling coils.

26. The reactor coolant pump of claim 25 wherein said thermal barrier further comprises an annular shim concentric with said central opening and dispose between said end wall and said stack of pancake cooling coils and having a collar around said pump shaft and extending axially away from said end wall, said collar having a plurality of circumferentially distributed radially extending through holes.

27. The reactor coolant pump of claim 26 wherein said external insulator comprises a sleeve shrink fit over said generally cylindrical cover and forming with the generally cylindrical cover an annular chamber containing substantially stagnant reactor coolant water.

28. The reactor coolant pump of claim 24 wherein said thermal barrier further includes a plurality of pancake cooling coils disposed axially along said pump shaft inside said generally cylindrical cover and an annular shim concentric with said central opening in said end wall and disposed between said end wall and said plurality of pancake cooling coils, said annular shim having a collar extending around said pump shaft and axially away from said end wall.

29. The reactor coolant pump of claim 28 wherein said collar has plurality of circumferentially distributed radially extending through holes.

* * * * *